US006438755B1

(12) United States Patent
MacDonald et al.

(10) Patent No.: US 6,438,755 B1
(45) Date of Patent: Aug. 27, 2002

(54) AERODYNAMIC GARMENT FOR IMPROVED ATHLETIC PERFORMANCE AND METHOD OF MANUFACTURE

(75) Inventors: Richard C. MacDonald, Portland, OR (US); Edward L. Harber, Midhurst (GB)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/663,117

(22) Filed: Sep. 15, 2000

(51) Int. Cl.[7] ..... A41D 13/00
(52) U.S. Cl. ..... 2/69
(58) Field of Search ..... 2/69, 1, 456, 458, 2/2.14

(56) References Cited

U.S. PATENT DOCUMENTS 3,835,470 A * 9/1974 Greiter ..... 2/79
5,033,116 A * 7/1991 Itagaki et al. ..... 2/67
5,052,053 A * 10/1991 Peart et al. ..... 2/2.1
5,415,924 A * 5/1995 Herlihy, Jr. ..... 428/284
5,631,074 A * 5/1997 Herlihy, Jr. ..... 442/35
5,745,917 A * 5/1998 Dicker et al. ..... 2/69
5,809,567 A * 9/1998 Jacobs et al. ..... 2/1
5,836,016 A * 11/1998 Jacobs et al. ..... 2/69
5,857,947 A * 1/1999 Dicker et al. ..... 482/124
5,875,491 A * 3/1999 Wilkinson ..... 2/69
6,098,198 A * 8/2000 Jacobs et al. ..... 2/69
6,231,488 B1 * 5/2001 Dicker et al. ..... 482/124

OTHER PUBLICATIONS

"FABRIC" by Speedo Fast.skin, Catalogue (2 pp.), prior to Sep. 15, 2000.

* cited by examiner

*Primary Examiner*—John J. Calvert
*Assistant Examiner*—Alissa L. Hoey
(74) *Attorney, Agent, or Firm*—Banner & Witcoff, Ltd.

(57) ABSTRACT

An aerodynamic suit for improved athletic performance, and a method of manufacturing the suit. Each body segment is assigned a Reynolds number based upon the velocity and size of the body segment. Each body segment has an appropriate textile assigned to it. The texture of the textile is appropriate to the Reynolds number. As a result, each body segment should go through transition simultaneously during the athletic event. The limbs of the suit are preferably cut so that the seams between the limbs and the rest of the suit are at angles parallel to the direction of movement when at estimated maximum velocity to thereby reduce creases and aerodynamic drag resulting therefrom.

32 Claims, 7 Drawing Sheets

AERODYNAMIC GARMENT FOR IMPROVED ATHLETIC PERFORMANCE AND METHOD OF MANUFACTURE

1. Field of the Invention

The present invention relates to an aerodynamic garment, such as a suit, for improved athletic performance and method of manufacture. More particularly, the present invention relates to a garment formed from textiles that are optimized to specific speed ranges and the speed of a particular body area as well as the frontal areas of the body segments so as to minimize air resistance and pressure drag.

2. Background of the Invention

In high-speed individual sports, such as speed skating, skiing, bicycling and running, air resistance or drag is major force acting against the athlete and the wind resistance significantly retards the speed of the athlete.

In sprint and middle distance running, systematic attempts to reduce aerodynamic drag have been sporadic. Most efforts have focused on running technique. Apparel-related methods of reducing drag center on altering the shape an athlete presents to the drag-producing air stream.

The energy required to overcome drag at sprint (10 m/s) and middle distance (6 m/s) speeds has been estimated to range between 13.6%, and 3% respectively, of the total energy expenditure in running. The energy expenditure to overcome drag for bicycle racing is an even greater percentage of the total energy expenditure for speeds in excess of 20 miles/hour.

The drag force on an athlete is the same as that on any other speeding object such as a bullet or an airplane, and is given by:

$$Fd=0.5pApC_dV^2 \quad \text{(Equation 1)}$$

where Fd is the drag force (measured in Newtons); p is the air density (kg/m$^3$); Ap is the projected or frontal area of the athlete normal to the wind (m$^2$); $C_d$ is a non-dimensional drag coefficient determined by the geometric orientation and shape of the body, and V is the body velocity in still air (m/s). Drag force has pressure and frictional components. Friction drag is due to surface imperfections while pressure drag results from pressure differences between the wind facing and trailing surfaces of a body.

Air pressure is reduced in trailing regions wherever the airflow separates from the surface and leaves a low-pressure cavity. Such pressure differences, acting perpendicularly to the surface, cause large retarding forces. The drag force as exemplified in Equation 1 shows that drag increases proportional to the square of velocity. Power is proportional to the product of the drag force and velocity, so that the power required to overcome retarding forces and drive an athlete through the air increases as the cube of velocity. Consequently, doubling the forward velocity of an athlete requires an eight-fold increase in energy expenditure to overcome drag.

As is evident from Equation 1, a reduction in air density, projected area or drag coefficient will decrease drag and allow maintenance of a higher forward velocity without additional energy expenditure. The effect of reduced drag is most apparent in races conducted at a high altitude, such as at Mexico City, where air density is decreased approximately 23% from sea level.

Other than by drafting or racing at high altitude, a reduction in drag force will only be achieved by presenting a more streamlined shape to the wind (reduce the value of Ap). Good examples of techniques to reduce Ap are the crouched postures of downhill skiers, cyclists and speed skaters. The adoption of a full crouch position, compared with an upright position, has been estimated to provide a time saving of nearly three minutes in a 40 km cycling time trial at a velocity of 13.4 m/s.

Loose or baggy clothing can increase the drag area and aerodynamic drag on a runner, cyclist or Nordic skier by up to 41%. A skintight suit that covers body hair and eliminates the protrusions, flaps and edges of traditional loose apparel will reduce the Ap of an athlete. To be effective, the suit must fit the body tightly, particularly in the position of movement. By presenting only smooth, unwrinkled fabric to the wind facing portions of the body the so-called "wet edges" of airflow, aerodynamic drag can be further minimized.

In many athletic events, the difference between winning and losing can come down to a fraction of a second. An athlete using apparel that can reduce aerodynamic drag can potentially bridge the gap between winning and losing. An improved body suit for an athlete that reduces aerodynamic drag was thus needed.

SUMMARY OF THE INVENTION

These obstacles are addressed by the present invention, which is directed to an aerodynamic suit for improved athletic performance, and a method of manufacturing the suit.

Each body segment is assigned a Reynolds number based upon the velocity and size of the body segment. Each body segment has an appropriate textile assigned to it. The texture of the textile is appropriate to the Reynolds number. As a result, each body segment should go through transition simultaneously during the athletic event to minimize drag flow.

The limbs of the suit may be cut so that the seams between the limbs and the rest of the suit are at angles parallel to the direction of movement when at estimated maximum velocity to thereby reduce creases and aerodynamic drag resulting therefrom.

From the foregoing, it is an object of the present invention to provide an athletic suit having body segment Reynolds numbers matched with fabric to reduce the body segment drag coefficient in the range of Reynolds numbers experienced by the body segment during the intended athletic activity.

Another object of the present invention is to provide a method of manufacturing an athletic suit having body segment Reynolds numbers matched with fabric to reduce the segment drag coefficient in the range of Reynolds numbers experienced by the body segment during the intended athletic activity.

Yet another object of the present invention is to provide an athletic suit in which the athlete will experience an early transition of laminar to turbulent airflow during the intended athletic activity.

Still another object of the present invention is to provide an athletic garment made from at least two different fabrics that cover different body segments of the athlete. The fabrics are selected based upon the ranges of speeds of the body segments during an athletic event to minimize coefficients of drag experienced by each of the body segments during said athletic event.

BRIEF DESCRIPTION OF THE DRAWINGS

These and other attributes of the present invention will be described with respect to the following drawings in which.

DETAILED DESCRIPTION OF THE INVENTION

Figure 1:
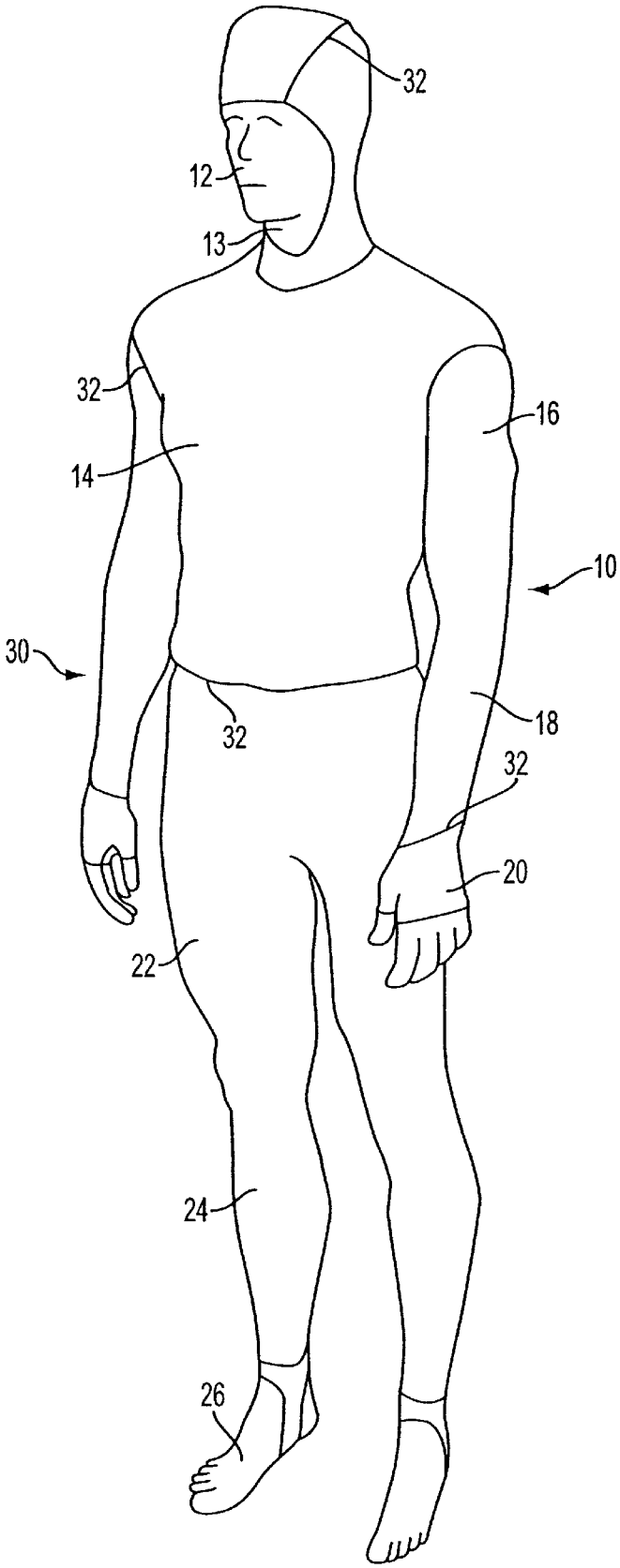
FIG. 1 is a front elevational view of an athlete defining various body segments.

In many athletic events, the difference between winning and losing can come down to a fraction of a second. An athlete using apparel that can reduce aerodynamic drag can potentially bridge the gap between winning and losing.

The present invention is directed to an athletic suit 30 that strategically uses different fabrics to cover different body parts to reduce the drag force encountered by athletes during various activities. Different fabrics can cause a reduction in drag coefficient at different Reynolds numbers. Consequently specific fabrics can be selected for use over particular body segments in order to optimize a reduction of wind resistance incurred by an athlete. Body segments have different characteristic widths and velocities, and as a result have different maximum Reynolds numbers. According to the method of manufacture, the athlete's body segment Reynolds numbers are matched with fabrics to optimally reduce the segment drag coefficient in the range of Reynolds numbers experienced by the body segment during an athletic event, such as a sprint race.

The Reynolds number (Re) is a dimensionless constant defined as:

$$Re = l\ V\ v^{-1}$$

where l is a representative dimension of the body, such as diameter or length, V is the velocity of the body in still air, and v is the kinematic viscosity of the air at a particular temperature and pressure. For a sphere at sea-level pressure and room temperature (19° C.):

$$Re = \tfrac{2}{3}\ \text{sphere diameter} \times \text{relative velocity} \times 10^5$$

where the diameter is in meters and the relative velocity (defined as the vector sum of sphere and wind velocities) is in m/s.

The drag coefficient is virtually constant for flat plates and other objects that are predominantly influenced by pressure drag. In contrast, the drag coefficient of non-flat or circular structures, such as circular cylinders or spheres, is subject to tremendous variation. Many portions of the human body, such as arms, legs, torso, and head approximate circular or cylindrical structures and are subject to tremendous variations in drag coefficients. At a critical Reynolds number ($Re_{crit}$) between $3\times10^5$ and $4\times10^5$ the boundary layer surrounding a circular cylinder or sphere will spontaneously change from laminar to turbulent flow. The lowest integrated drag on an object occurs when the laminar boundary layer on the front part of the body becomes turbulent enough so that boundary layer separation is delayed and the wake of the object is narrowed. On wake narrowing, there is a concomitant decrease in drag coefficient (Cd) from approximately 1.0 to as low as 0.4. Such a phenomenon is called flow transition. As the Reynolds number is further increased, the Cd will increase from a minimum to a stable value lower than that originally held. The value of the Cd at the onset of this plateau is termed the "transcritical drag coefficient."

Flow transition has particular relevance for human movement because the body is approximately similar, aerodynamically, to a series of spheres and circular cylinders. In upright human motion, the velocity required to generate flow transition has been estimated to be nearly 6 m/s for a cross-country skier, (height of the skier is 1.8 m), under 10 m/s for an upright cyclist (diameter of 0.6 m), and over 18 m/s for a runner.

Figure 2:
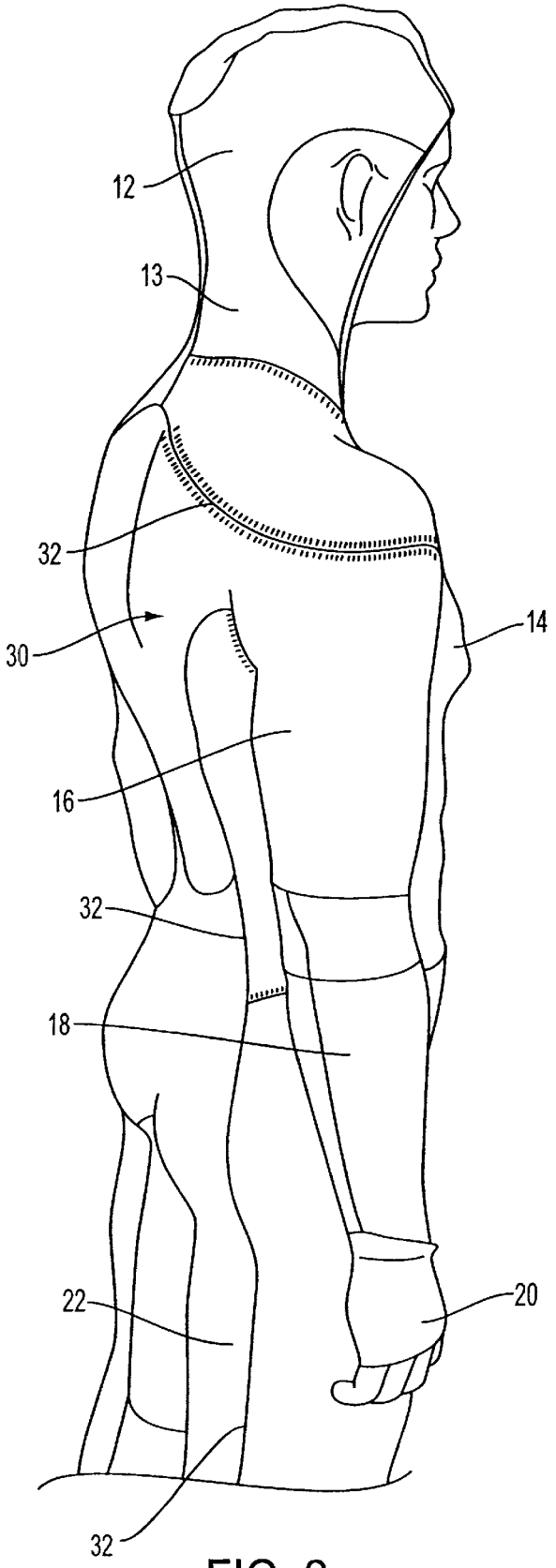
FIG. 2 is a front elevational view of an athletic suit according to the present invention.
Figure 3:
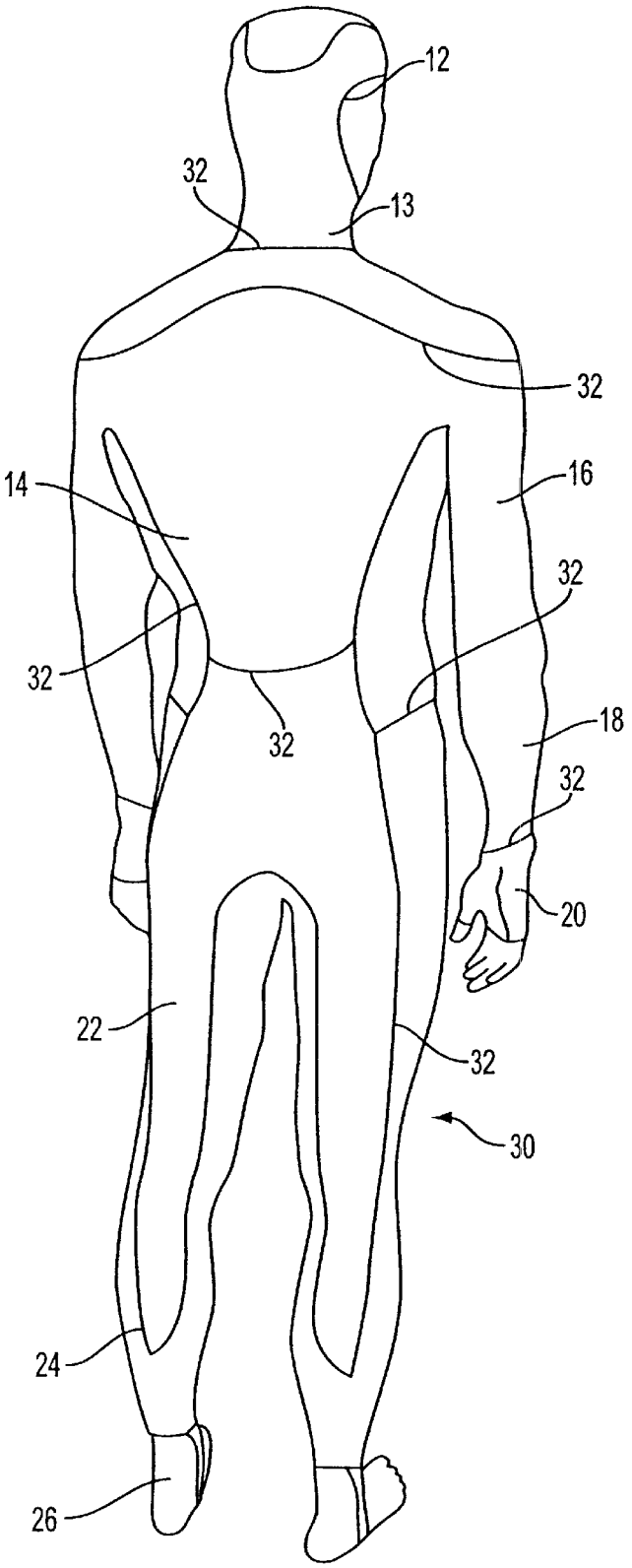
FIG. 3 is a rear perspective view of an athletic suit according to the present invention.

Referring to FIGS. 1–3, an athlete 10 is shown and the various body segments are enumerated. The athlete's body is broken down into a head segment 12, a neck segment 13, a torso segment 14, upper arm segments 16 (which are generally defined as the region of the arm between the shoulder and the elbow), lower arm segments 18 (which are generally defined as the regions between the elbow and the wrist), hand segments 20, upper leg segments 22 (which are generally defined as the regions between the hips and the knees), lower leg segments 24 (which are generally defined as the regions between the knees and the ankles), and feet segments 26. The suit 30 includes body segment portions corresponding to the body segments of the athlete, enumerated above.

The cut, fit, and placement of seams 32 on the athletic suit 30, shown in FIGS. 1–3, may also influence the drag force. The athletic suit 30 should fit the athlete as tightly as feasible. Consequently, each suit 30 will need to be tailored to the dimensions of the individual athlete and particular athletic event. In order further to reduce aerodynamic drag, all the seams 32 for the garment 30 are preferably horizontal to thereby minimize airflow around the garment. In addition, the joints should be cut at right angles.

To determine drag, wind tunnel tests were performed on a variety of fabrics placed on cylinders. A metric balance was employed to measure the forces on the cylinders at varying wind speed, to determine the effectiveness of the fabrics with decreasing wind resistance. Force on the cylinders was determined by using a one-component force balance.

Figure 4:
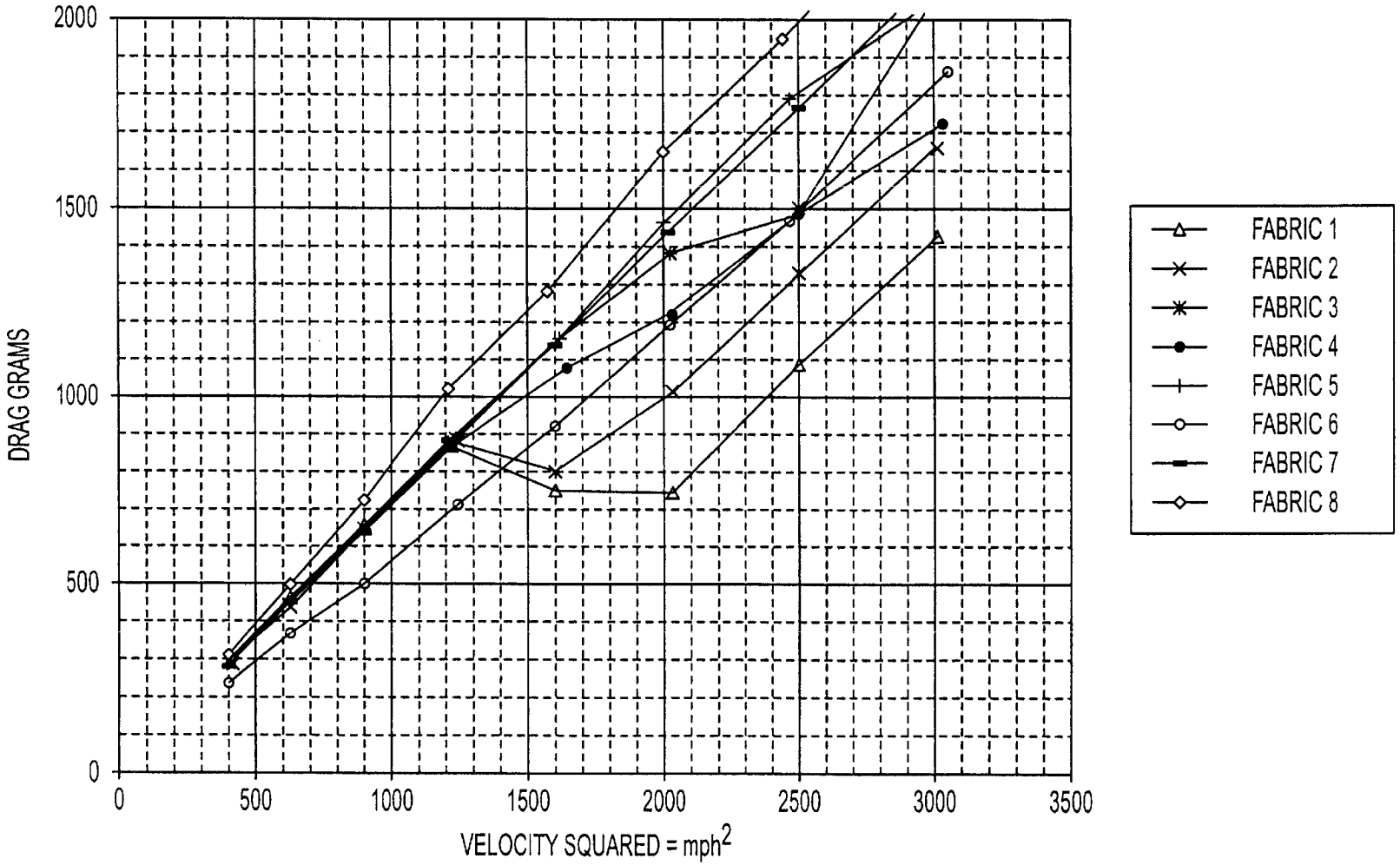
FIG. 4 is graph plotting the magnitude of the difference in wind drag on a cylinder coated with various fabrics using force verses velocity squared.

The actual magnitude of the difference in wind drags on the various objects covered with different materials was plotted using force verses velocity squared. FIG. 4 shows the relationship of the drag as a function of the square of the wind velocity for eight different fabrics 1–8, covering a cylinder having a 3.5 inch diameter and 25.2 inch height. A straight line indicates that the drag is directly proportional to the velocity squared. Changes in slope are caused by transitions from laminar to turbulent flow.

The Reynolds numbers and maximum speeds, shown in Table 1, were used in the calculations for the selection of fabrics.

| Body Seg. | Est. Max Speed | Diameter | Max Reynolds |
|---|---|---|---|
| Head | 12 m/s, 27 mph | 6 inches | $1.24 \times 10^5$ |
| Torso | 12 m/s, 27 mph | 15 inches | $3.1 \times 10^5$ |
| Upper Arm | 15 m/s, 33.6 mph | 3.5 inches | $0.90 \times 10^5$ |

-continued

| Body Seg. | Est. Max Speed | Diameter | Max Reynolds |
|---|---|---|---|
| Lower Arm | 18 m/s, 40.3 mph | 3 inches | $0.92 \times 10^5$ |
| Thigh | 18.4 m/s, 41.2 mph | 6 inches | $1.89 \times 10^5$ |
| Lower Leg | 19.8 m/s, 44.3 mph | 3.5 inches | $1.19 \times 10^5$ |

The cylinder force readings were accurate and repeatable to approximately 5 grams. Tests in different wind tunnels yielded the same results, and the transition points were invariably in the same speed range. Prior to the transition point, at lower speed ranges, the difference in drag between fabrics was only a few grams. After the transition point, in the higher speed ranges, the drag differences were often several hundred grams. During running, the limbs of the athlete go through a wide range of speeds and angles with each stride. Consequently, the fabrics should be selected with regard to the span of expected velocities and angles. Only the trunk of the body and the head and neck remain at a relatively constant speed and angle.

Figure 5:
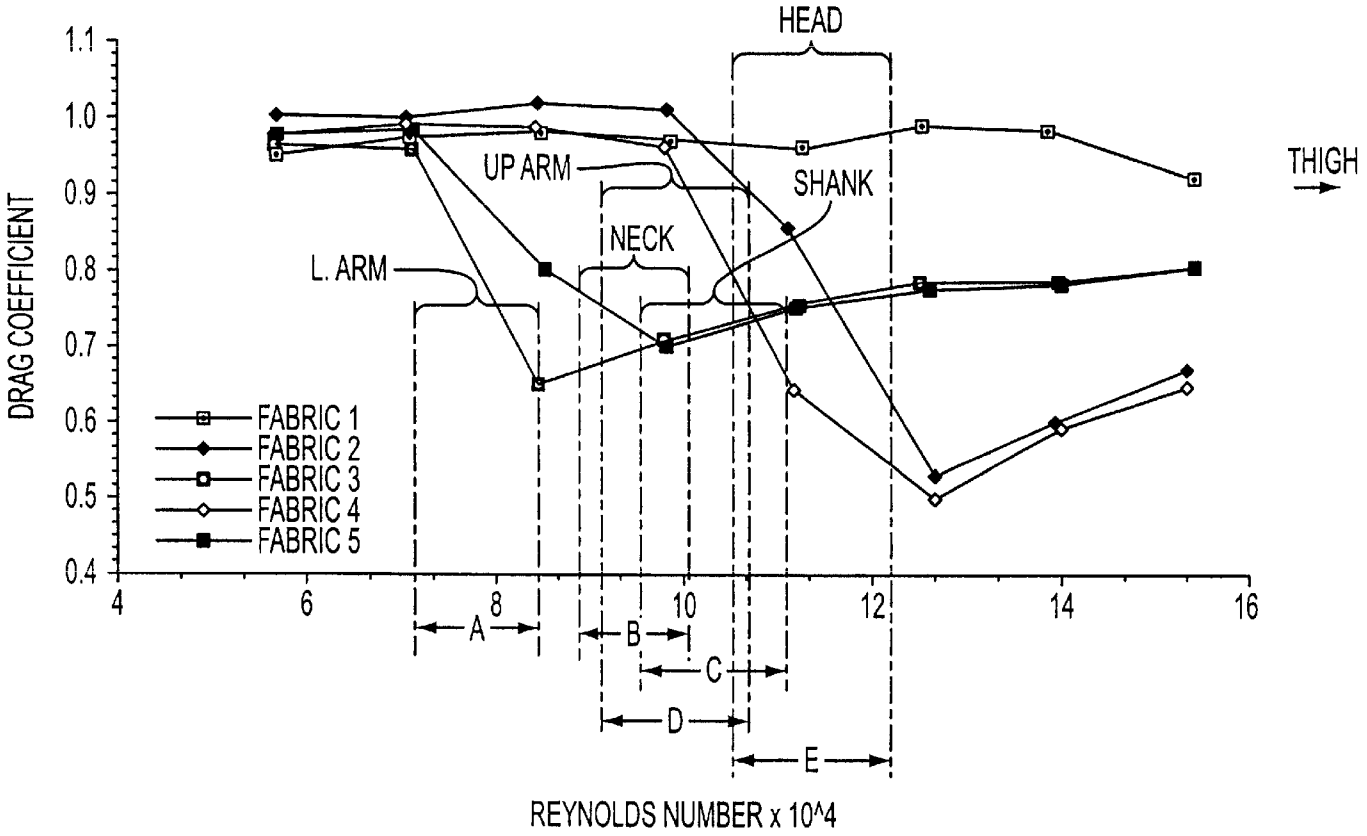
FIG. 5 is graph plotting the magnitude of the difference in wind drag on for different fabrics verses the Reynolds number.

A graph illustrating a comparison of aerodynamic drag on a cylinder, 3.5 inches in diameter, and 14.5 inches high for five different fabrics is shown in FIG. 5. From FIG. 5 it is clear that different fabrics undergo transition in the Reynolds number ranges for different body segments. Segment A corresponds to the Reynolds number for the lower arm, Segment B corresponds to the Reynolds number for the neck, Segment C corresponds to the Reynolds number for the thigh, Segment D corresponds to the Reynolds number for the upper arm, and Segment E corresponds to the Reynolds number for the head.

The transition speeds vary widely, from less than 30 mph to about 45 mph. Fabrics that go through transition very early usually have a comparatively lower drag at low speeds and a comparatively higher drag at high speeds. The fabric can be classified into basically three different categories: fabrics that go through a radical transition, fabrics that go through an early and mild transition, and fabrics that go through almost no transition. The different categories of fabrics have applications in different speed ranges.

The following fabrics are the preferred fabrics for various body segments, with the best fabric listed first.

Head: (Maximum Re=$1.24\times10^5$) Nylon/spandex unlaminated textured tricot. Polyester/spandex unlaminated textured tricot. Polyester/spandex mesh Neck: Nylon/spandex unlaminated textured tricot. Nylon/spandex mesh Polyester/spandex unlaminated textured tricot. Polyester/spandex laminated textured. Polyester/spandex mesh Torso: (Maximum Re=$3.1\times10^5$) Polyester/spandex tricot.

Upper Arm: (Maximum Re=$0.9\times10^5$) Polyester/spandex unlaminated textured tricot. Polyester/spandex laminated textured. Polyester/spandex mesh Lower Arm: (Maximum Re=$0.92\times10^5$) Polyester/spandex unlaminated textured tricot. Polyester/spandex laminated textured. Polyester/spandex mesh Hand: Polyurethane coated nylon/spandex tricot.

Thigh: (Maximum Re=$1.89\times10^5$) Polyester/spandex velour. Polyester/spandex unlaminated textured tricot. Polyester/spandex laminated textured.

Lower Leg/Shank: (Maximum Re=$1.19\times10^5$) Polyester/spandex unlaminated textured tricot. Polyester/spandex laminated textured. Polyester/spandex mesh The selection of appropriate fabric for each body segment was based on the Reynolds number at less than the estimated maximum velocities for the particular body segment. The fabrics were chosen, not only based upon low Cd in the velocity range for a particular body segment, but also based upon the degree of uniformity of a low Cd over the velocities leading up to the maximum segment velocity. To obtain benefits, the suit 30 is preferably designed specific to the general size of the athlete, the event performed by the athlete, and the approximate speeds of the athlete when performing the event.

The fabric recommendations are dependent on the average diameter of the limb segment being covered. For example, a female sprinter typically has smaller limbs and a lower velocity than those of a male sprinter. The combination, of lower velocity and smaller segment diameter, may make separate suit desirable. If the average circumference of a woman's torso is 66 cm, then her torso diameter is 21.03 cm. At a velocity of 10 m/s, her maximum torso Re is $14.5\times10^4$, which is close to the maximum thigh Re for a male sprinter. Consequently, different torso fabrics would be appropriate for these situations.

A scale model of a lower leg was mounted vertically in a wind tunnel and covered with fabric sleeves from top to ankle level. The model was tested at speeds from 25 to 45 mph in increments of 5 mph. Two tendon fairings were inserted into the leg cover, a small and a large fairing. Both fairings gave a slightly lower drag than the fabric alone did. The large fairing was more effective at speeds of 40 mph and below, while the large fairing was more effective at speeds of 45 mph to 55 mph.

By selecting low wind resistant fabrics for athletic apparel, the speed the athlete achieves can be improved without revising the training methods, or resorting to other traditional techniques for improving athletic performance. Effective fabric selection required quantitative testing of fabric on various parts of the human body.

The suit may be provided with a tightly fitted head portion 25. Such is desirable for athletes having any appreciable amount of hair. While a bald, or nearly bald, head will have less drag than a hooded head, due to the increase in frontal area and surface irregularities created by the hood, any type of long hair will increase the drag on the head by up to 340 grams. Covering any realistic length of hair in a hood will reduce the drag on the hood towards the drag measured on the bare skin. Consequently, a hood may be provided on the suit to cover hair and reduce aerodynamic drag without impairing hearing. The hood may have a mesh portion 27 that is lined to prevent hair from protruding, which would affect the surface texture of the fabric and thereby negatively effect the aerodynamic properties, as shown in FIG. 2.

Referring to FIG. 3, the seams 32 of the suit are moved to the back of the suit to reduce drag (or airflow separation). Seams 32*a* located on the front of the suit may be low profile and may be positioned with the direction of airflow. The seams 32*a* are preferably cut to be horizontal when at maximum velocity, thereby minimizing the effect of such seams at high speeds. Seams located at the wrist are examples of such seams.

The suit can have an invisible, bar-tacked, re-enforced, center front zip. A rear zip would provide a smooth front and consequently less drag. Loop side Velcro™ pads may be attached to or printed on the suit 30, to more effectively secure the race number.

In the preferred embodiment, as shown in FIGS. 1–3, the portion of the suit covering the back of a body part is preferably made with a different fabric than that fabric covering the front of the respective body part. In the preferred embodiment, a single fabric may cover the entire front portion of a single body segment. The same or a different fabric may cover the back of that that body segment. It is contemplated that only one fabric will cover the front of each body segment, as the body segments are defined herein.

Covering a body segment with two different fabrics so that each of the fabrics covers approximately half of the body segment produces a composite pattern of flow transition. Consequently, areas of an athletic suit requiring special non-aerodynamic fabrics for muscle heat retention could be covered with a more aerodynamic fabric to improve the overall aerodynamic characteristic of the suit.

Small diameter leg and arm segments move at higher velocities than the torso, and consequently, these smaller diameter segments may undergo flow transition before the torso. The different fabrics can be used to induce simultaneous flow transition for all the body segments.

Figure 6C:
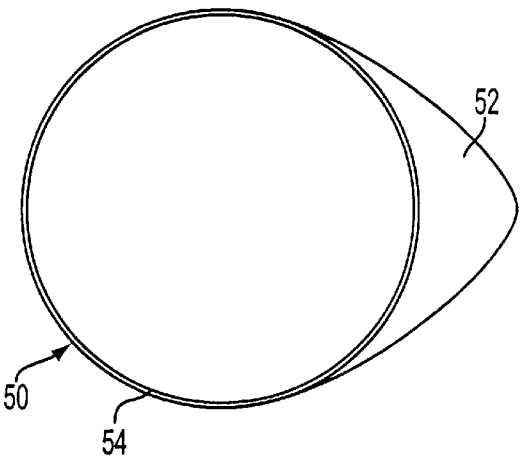
FIGS. 6*a*, 6*b* and 6*c* are side, front and top views, respectively, of a neck fairing according to the present invention.
Figure 6B:
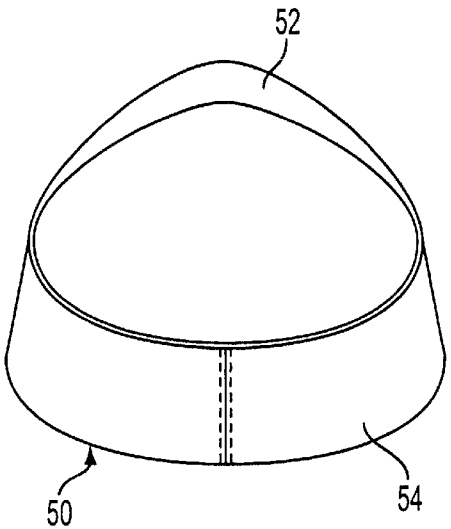
Figure 6A:
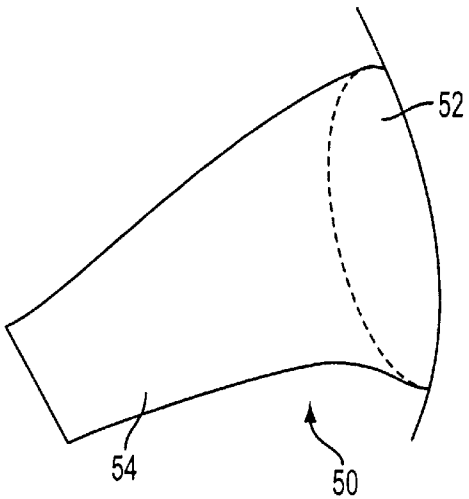
Figure 7:
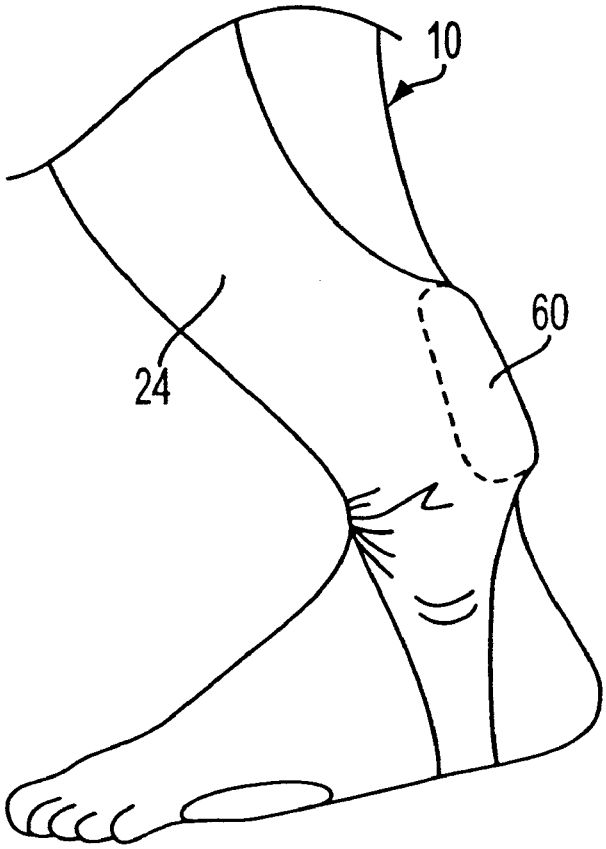
FIG. 7 is a perspective view of a fairing for positioning behind the Achilles tendon, at the ankle according to the present invention.

Referring to FIGS. 6*a–c* and 7, small fairings made, for example, from foam material may be employed behind the neck of the athlete, FIGS. 6*a–c*, and/or over the Achilles tendon, FIG. 7, at the ankle, to provide measurable and significant reductions in body segment drag.

The neck fairing 50, shown in FIGS. 6*a–c*, may include a foam pad 52 located over the nape of the athlete's neck. A fabric cover may be provided to hold the pad 52 in position. The cover 54 is preferably made from material chosen to minimize the coefficient of drag of the neck body segment. In the event that a hood is employed in the athletic suit, the hood itself can be used to hold the pad 52 in position, and the separate cover 54 is not needed.

FIG. 7 illustrates the leg fairing 60 for use over the athlete's Achilles tendons. The fair 60 is preferably made from a foam material molded to an athlete's leg. The fairing 60 may be held in position by the inherent elasticity of the lower leg portion 24 of the athletic suit 30.

The hands of the athlete are preferably covered with a low friction coated textile appropriate to the high velocity and relatively small size of the hands.

Any graphics on the suit are preferably screen printed on the rear so as to not affect drag.

The body heat of the athlete may be vented or retained at particular locations of his or her body by the use of particular materials and colors. In specific zones, fabric laminates and dark colors may be employed to retain body heat, while in other areas heat may be vented by using mesh and light colors. For example, a dense, elastic laminate may be used on the upper leg to provide heat retention and support, and simultaneously being breathable, elastic and aerodynamic. The rear of the upper leg may be made from a dense lightweight material for heat ventilation and flexibility.

If the athlete uses eyewear and the suit is employed with a hood having a mesh portion, the eyewear may be placed through the mesh hood thereby preventing dislocation of the eyewear, and preventing the hood from opening at the sides and producing a parachute effect.

In all embodiments, regardless of the preferred fabric, the fabric covering each body segment should have some elasticity so that it is tight fitting and stretches. It is important that the materials, from which the athletic suit is formed, be elastic enough to permit the athlete the full range of necessary movement for the specific athletic event. To this end, the fabric utilized in the athletic suit preferably stretches at least 30% in the lengthwise and widthwise directions. For each body segment, the fabric covering the front and the back of the body segment may be different in order to meet the requirements of reduced drag and heat retention and ventilation.

Having described several embodiments of the athletic suit in accordance with the present invention, it is believed that other modifications, variations and changes will be suggested to those skilled in the art in view of the description set forth above. For example, all of the fabrics set forth above were chosen based upon the assumption that they would be used in still air. The fabric may change if the athletic event will be performed in a head wind or tail wind. It is therefore to be understood that all such variations, modifications and changes are believed to fall within the scope of the invention as defined in the appended claims.

What is claimed is:

1. An athletic garment comprising:

a first fabric for covering substantially an entire front of a torso of an athlete, a second fabric for covering substantially an entire front of a first appendage of the athlete, and a third fabric for covering substantially an entire front of a second appendage of the athlete; said first, second, and third fabrics being different and having different drag properties.

2. An athletic garment as recited in claim 1, further comprising a fourth fabric for covering substantially an entire front of a third appendage of said athlete, being different and having different drag properties than said first, second, and third fabrics.

3. An athletic garment as recited in claim 1, wherein said first fabric is polyester/spandex tricot, said second fabric is polyester/spandex unlaminated textured tricot, and said third fabric is polyester/spandex velour.

4. An athletic garment as recited in claim 3, wherein said first appendage is one of said upper arm and lower arm and said second appendage is one of said thigh and hand.

5. An athletic garment as recited in claim 3, wherein said first appendage is one of said thigh and lower leg.

6. An athletic garment as recited in claim 3, wherein said second appendage is one of said thigh and hand.

7. An athletic garment as recited in claim 1, wherein said second fabric is polyester/spandex unlaminated textured tricot, and said third fabric is polyester/spandex velour.

8. An athletic garment comprising:

a first fabric for covering substantially an entire front of a first body segment, and a second fabric, different from said first fabric, for covering substantially an entire front of a second body segment, wherein said first and second fabrics are from the set of the following fabrics:

nylon/spandex unlaminated textured tricot,
polyester/spandex unlaminated textured tricot;
polyester/spandex laminated textured tricot;
polyurethane coated nylon/spandex tricot,
polyester/spandex laminated tricot,
polyester/spandex tricot,
polyurethane coated nylon/spandex tricot, and
polyester/spandex velour.

9. The athletic garment of claim 8 wherein said garment produces a lower cumulative coefficient of drag experienced by an athlete in a predetermined event than a garment made entirely from said first fabric and produces a lower cumulative coefficient of drag then a garment made entirely from said second fabric.

10. The athletic garment of claim 8, wherein said first and second body segments are selected from the set of a head, a neck, a torso, upper arms, lower arms, hands, upper legs, lower legs, and feet.

11. The athletic garment of claim 8, wherein said at least two different fabrics have different surface textures.

12. The athletic garment of claim 8, wherein said first and second fabrics are assembled so that seams in said garment are approximately horizontal when said body segments are moving at an estimated maximum velocity for a predetermined sports event.

13. The athletic garment of claim 8, further comprising at least one fairing disposed at one of a base of a neck, behind Achilles tendons, and both said base of said neck and behind said Achilles tendons.

14. The athletic garment of claim 8, further comprising a third fabric different from said first fabric for covering at least a portion of the back of the first body segment.

15. The athletic garment of claim 8, wherein a third fabric, different from said first and second fabrics, covers substantially an entire front of a third body segment.

16. The athletic garment of claim 15, wherein a fourth fabric, different from said first, second, and third fabrics, covers substantially an entire front of a fourth body segment.

17. The athletic garment of claim 15, wherein said first, second, and third body segments include a torso, a thigh and an upper arm.

18. The athletic garment of claim 8, wherein said first and second fabric can stretch at least 30% in both lengthwise and widthwise directions.

19. The athletic garment of claim 8, wherein said first and second body segments include a thigh and a lower leg.

20. The athletic garment of claim 8, wherein said first and second body segments include an upper arm and a lower arm.

21. An athletic garment comprising:

a first fabric for covering substantially an entire front of a first body segment, and a second fabric, different from said first fabric, for covering substantially an entire front of a second body segment, and a third fabric, different from said first and second fabric, for covering substantially an entire front of a third body segment, said first, second, and third fabrics having different drag properties.

22. The athletic garment of claim 21 wherein said garment produces a lower cumulative coefficient of drag experienced by an athlete in a predetermined event than a garment made entirely from said first fabric and producing a lower cumulative coefficient of drag then a garment made entirely from said second fabric.

23. The athletic garment of claim 21 wherein said garment produces a lower cumulative coefficient of drag experienced by an sprinter in a sprint than a garment made entirely from said first fabric, said second fabric, and said third fabric.

24. The athletic garment of claim 21, wherein said body segments are selected from the set of a head, a neck, a torso, upper arms, lower arms, hands, upper legs, lower legs, and feet.

25. An athletic garment as recited in claim 24, wherein said first, second, and third fabrics are assembled so that seams in said garment are approximately horizontal when said body segments are moving at an estimated maximum velocity.

26. An athletic garment as recited in claim 21, further comprising at least one fairing disposed at one of a base of a neck, behind Achilles tendons, and both said base of said neck and behind said Achilles tendons.

27. The athletic garment of claim 21, wherein a fourth fabric, different from said first, second, and third fabrics, covers substantially an entire front of a fourth body segment.

28. The athletic garment of claim 21, wherein said first and second fabric can stretch at least 30% in both lengthwise and widthwise directions.

29. The athletic garment of claim 21, wherein said first and second body segments include a thigh and a lower leg.

30. The athletic garment of claim 21, wherein said first and second body segments include an upper arm and a lower arm.

31. The athletic garment of claim 21, wherein said first, second, and third body segments include a torso, a thigh and an upper arm.

32. An athletic garment comprising:

a first fabric for covering substantially an entire front of a first body segment, a second fabric, different from said first fabric, for covering substantially an entire front of a second body segment, said garment producing a lower cumulative coefficient of drag experienced by an athlete in a predetermined event than a garment made entirely from one of said first fabric and said second fabric, wherein said body segments are selected from the set of a head, a neck, a torso, upper arms, lower arms, hands, upper legs, lower legs, and feet, and wherein said first and second fabrics and said first and second body segments are selected from the set of:

a combination of polyester/spandex unlaminated textured tricot and polyester/spandex mesh for said head, a combination of polyester/spandex unlaminated tricot and polyester/spandex mesh for said neck, polyester/spandex laminated textured for said torso, one of polyester/spandex unlaminated textured tricot and polyester/spandex mesh for said upper arms, polyester/spandex unlaminated textured tricot for said lower arms, polyurethane coated nylon/spandex tricot for said hands, polyester/spandex laminated textured for said upper legs, and polyester/spandex unlaminated textured tricot for said lower legs.

* * * * *